US011381904B2

(12) United States Patent
Liao et al.

(10) Patent No.: US 11,381,904 B2
(45) Date of Patent: Jul. 5, 2022

(54) SOUND TRANSMISSION HOLDER AND RELATED SPEAKER ASSEMBLY ELECTRONIC DEVICE

(71) Applicant: Wistron Corporation, New Taipei (TW)

(72) Inventors: Ji-Cheng Liao, New Taipei (TW); Hung-Sen Yang, New Taipei (TW); Chang-Feng Lan, New Taipei (TW)

(73) Assignee: Wistron Corporation, New Taipei (TW)

( * ) Notice: Subject to any disclaimer, the term of this patent is extended or adjusted under 35 U.S.C. 154(b) by 0 days.

(21) Appl. No.: 17/185,865

(22) Filed: Feb. 25, 2021

(65) Prior Publication Data

US 2022/0116698 A1 Apr. 14, 2022

(30) Foreign Application Priority Data

Oct. 14, 2020 (TW) ..... 109135410

(51) Int. Cl.
*H04R 1/44* (2006.01)
*H04R 1/28* (2006.01)

(52) U.S. Cl.
CPC ..... *H04R 1/2803* (2013.01); *H04R 1/44* (2013.01)

(58) Field of Classification Search
CPC ..... H04R 1/02; H04R 1/021; H04R 1/025; H04R 2201/02; H04R 2205/021; H04R 1/44; H04R 1/2803
See application file for complete search history.

(56) References Cited

U.S. PATENT DOCUMENTS

2021/0377668 A1* 12/2021 Park ..... H04R 9/025

FOREIGN PATENT DOCUMENTS

CN 111163396 A 5/2020

* cited by examiner

*Primary Examiner* — Kile O Blair
(74) *Attorney, Agent, or Firm* — Winston Hsu

(57) ABSTRACT

A sound transmission holder transmits a sound signal output by a sound generating unit of an. The sound transmission holder includes a frame body, a first bridging portion, a second bridging portion and an accommodating portion. The frame body has a hollow portion. The frame body includes a first section, a second section and a third section. The first bridging portion and the second bridging portion are respectively disposed on the first section and the second section and abut against a casing of the electronic device to position the frame body. The accommodating portion is disposed on the third section and accommodates the sound generating unit. The sound signal is guided to the first bridging portion and the second bridging portion via the hollow portion.

20 Claims, 7 Drawing Sheets

SOUND TRANSMISSION HOLDER AND RELATED SPEAKER ASSEMBLY ELECTRONIC DEVICE

BACKGROUND OF THE INVENTION

1. Field of the Invention

The present invention relates to a sound transmission holder and a related speaker assembly and a related electronic device, and more particularly, to a sound transmission holder with a sound generating function and a waterproof function and a related speaker assembly and a related electronic device.

2. Description of the Prior Art

A conventional speaker device disposes two speaker units respectively on two sound penetrating holes formed on a casing of the speaker device to provide two-channel efficacy. The plurality of speaker units has expensive cost and wastes inner space of the speaker device. The speaker unit is directly adhered to the casing to provide the waterproof function; if the casing is redesigned due to change of outward appearance, the speaker unit may be difficult to accurately assemble with the resigned casing, so that the waterproof function is decreased or damaged accordingly. The resigned casing can include, but not be limited to, an inner surface changed from a continuous plane to an intermittent plane, or the inner surface changed from a smooth surface to an uneven surface, or the inner surface changed into smaller dimensions. In addition, a sound box of the conventional speaker device which is cooperated with the speaker unit has drawbacks of smaller space and an irregular shape due to mechanical design constraint of the conventional speaker device, and thus the speaker unit cannot provide preferred high frequency and low frequency efficacy.

SUMMARY OF THE INVENTION

The present invention provides a sound transmission holder with a sound generating function and a waterproof function and a related speaker assembly and a related electronic device for solving above drawbacks.

According to the claimed invention, a sound transmission holder of transmitting a sound signal output by a sound generating unit is disclosed. The sound transmission holder includes a frame body, a first bridging portion, a second bridging portion and an accommodating portion. The frame body has a first section, a second section and a third section. The first section and the second section are disposed on two opposite sides of the third section. The first section, the second section and the third section are hollow and connected to each other. The first bridging portion is one hollow structure disposed on the first section. The second bridging portion is another hollow structure disposed on the second section. The first bridging portion and the second bridging portion abut against an external casing and are connected to the inner space of the frame body. The accommodating portion is disposed on the third section, and the sound generating unit is connected to the accommodating portion.

According to the claimed invention, the first section, the second section and the third section are connected to form a sound transmission portion. The sound transmission portion has two opening ends opposite to each other, and a width of the first section is wider than a width of the third section.

According to the claimed invention, the accommodating portion is disposed on a first surface of the third section. The sound transmission holder further includes a sound box disposed on a second surface of the third section opposite to the first surface.

According to the claimed invention, the sound transmission holder further includes a covering portion disposed on the third section and adapted to cover the sound generating unit.

According to the claimed invention, the first bridging portion includes a waterproof contacting surface and an orientation abutting surface. The waterproof contacting surface contacts an inner wall of the external casing, and the orientation abutting surface abuts another inner wall of the external casing. An angle between a planar normal vector of the waterproof contacting surface and a planar normal vector of the orientation abutting surface is ranged between 30~75 degrees.

According to the claimed invention, the first bridging portion includes an annular protruding part disposed on the waterproof contacting surface and adapted to contact an annular slot of the external casing.

According to the claimed invention, the sound transmission holder further includes a first positioning portion disposed on one of the frame body and the accommodating portion, and adapted to engage with a second positioning portion of the external casing.

According to the claimed invention, the first bridging portion includes a stretching section.

According to the claimed invention, the first section includes a locking part and an adhesive leaking part, and the adhesive leaking part is disposed on the locking part and adjacent to the first bridging portion.

According to the claimed invention, the frame body further has a wire arrangement structure comprising at least one of a plank part and a bending part and adapted to constrain a signal transmission wire of the sound generating unit.

According to the claimed invention, an electronic device with a sound generating and waterproofing function includes a casing and a speaker assembly. The casing has an accommodating space. A first sound penetrating hole and a second sound penetrating hole of the casing are connected to the accommodating space. The speaker assembly includes a sound generating unit and a sound transmission holder. The sound transmission holder is disposed inside the accommodating space. The sound transmission holder includes a frame body, a first bridging portion, a second bridging portion and an accommodating portion. The frame body has a first section, a second section and a third section. The first section and the second section are disposed on two opposite sides of the third section. The first section, the second section and the third section are hollow and connected to each other. The first bridging portion is one hollow structure disposed on the first section and aligns with the first sound penetrating hole. The second bridging portion is another hollow structure disposed on the second section and aligns with the second sound penetrating hole. The first bridging portion and the second bridging portion abut against an inner wall of the casing. The accommodating portion is disposed on the third section, and the sound generating unit is connected to the accommodating portion.

According to the claimed invention, a speaker assembly includes a sound generating unit and a sound transmission holder. The sound transmission holder is assembled with the sound generating unit for transmitting a sound signal output by the sound generating unit. The sound transmission holder includes a frame body, a first bridging portion, a second bridging portion and an accommodating portion. The frame body has a first section, a second section and a third section. The first section and the second section are disposed on two opposite sides of the third section. The first section, the second section and the third section are hollow and connected to each other. The first bridging portion is one hollow structure disposed around the first section. The second bridging portion is another hollow structure disposed around the second section. The first bridging portion and the second bridging portion abut against an external casing. The accommodating portion is disposed on the third section, and the sound generating unit is connected to the accommodating portion, so that the sound signal is transmitted to the first bridging portion and the second bridging portion through the frame body.

The sound transmission holder and the related speaker assembly and the related electronic device of the present disclosure can design the sound transmission portion on the frame body, and the sound transmission portion can be connected to the sound penetrating holes of the casing via the bridging portions, so that one sound generating unit can provide multichannel sound efficacy. The bridging portion and the frame body can be integrated monolithically, or can be two independent components assembled with each other. The frame body of the sound transmission holder can have the sound box with the smooth shape and the covering portion for enlarging the sealed space, and therefore the sound generating unit can provide the preferred high frequency efficacy and the preferred low frequency efficacy. The bridging portion of the sound transmission holder can design the specific inclined angle of the waterproof contacting surface and the orientation abutting surface, and further dispose the annular protruding part on the bridging portion for providing the preferred waterproof efficacy of the sound transmission holder.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
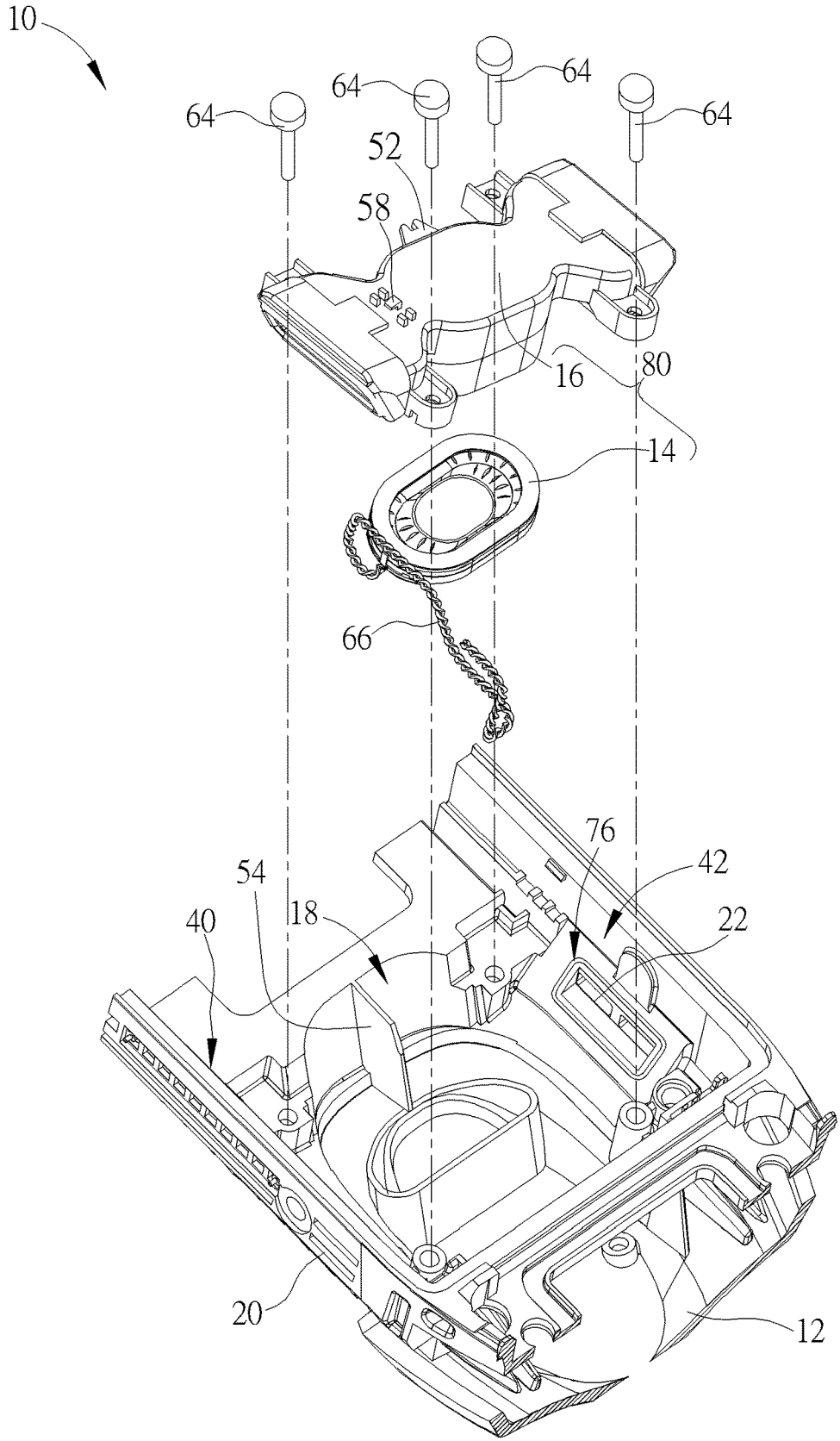
FIG. 1 is an exploded diagram of an electronic device according to an embodiment of the present disclosure.
Figure 2:
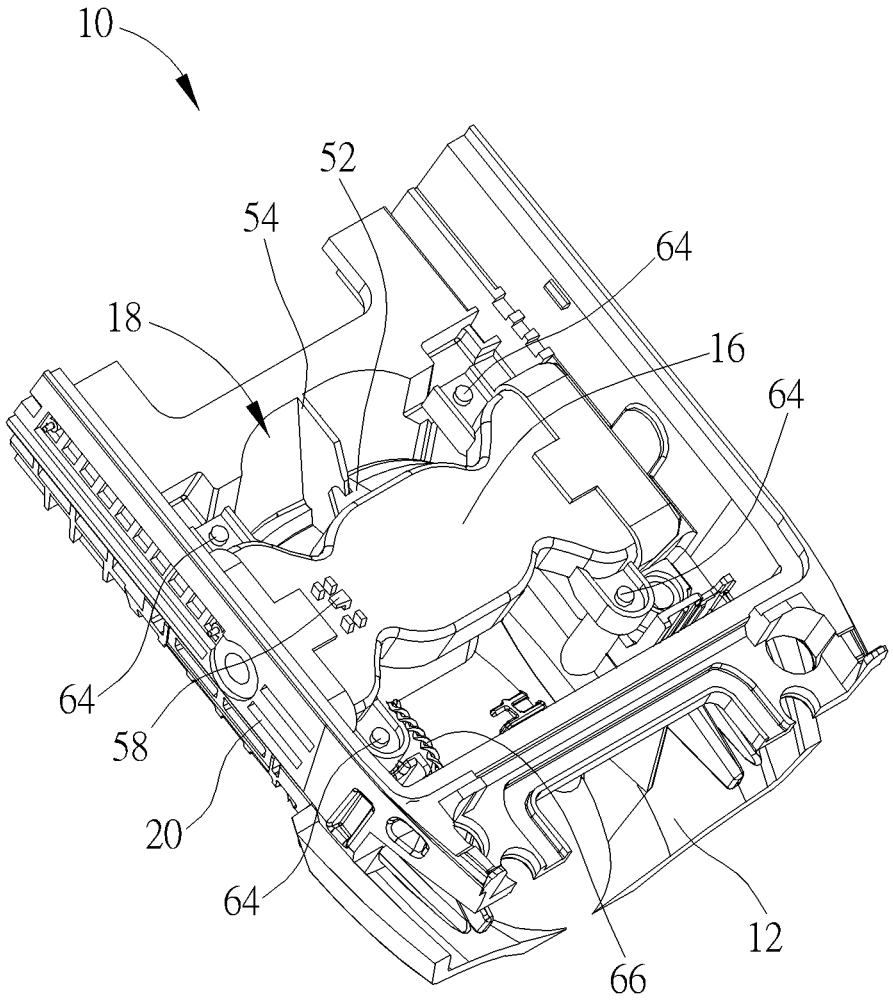
FIG. 2 is a schematic diagram of the electronic device according to the embodiment of the present disclosure.

Please refer to FIG. 1 and FIG. 2. FIG. 1 is an exploded diagram of an electronic device 10 according to an embodiment of the present disclosure. FIG. 2 is a schematic diagram of the electronic device 10 according to the embodiment of the present disclosure. The electronic device 10 can include a casing 12, a sound generating unit 14 and a sound transmission holder 16. The sound generating unit 14 can be assembled with the sound transmission holder 16 to form a speaker assembly 80. The casing 12 can have an accommodating space 18 used to accommodate the sound generating unit 14 and the sound transmission holder 16. The sound generating unit 14 can be a loudspeaker. The present disclosure can guide a sound signal output by the sound generating unit 14 to several sound penetrating holes formed on the casing 12 via the sound transmission holder 16. In the embodiment, the casing 12 can have a first sound penetrating hole 20 and a second sound penetrating hole 22 connected to the accommodating space 18. A number of the sound penetrating hole on the casing 12 is not limited to the embodiment shown in FIG. 1 and FIG. 2, which depends on a design demand.

Figure 3:
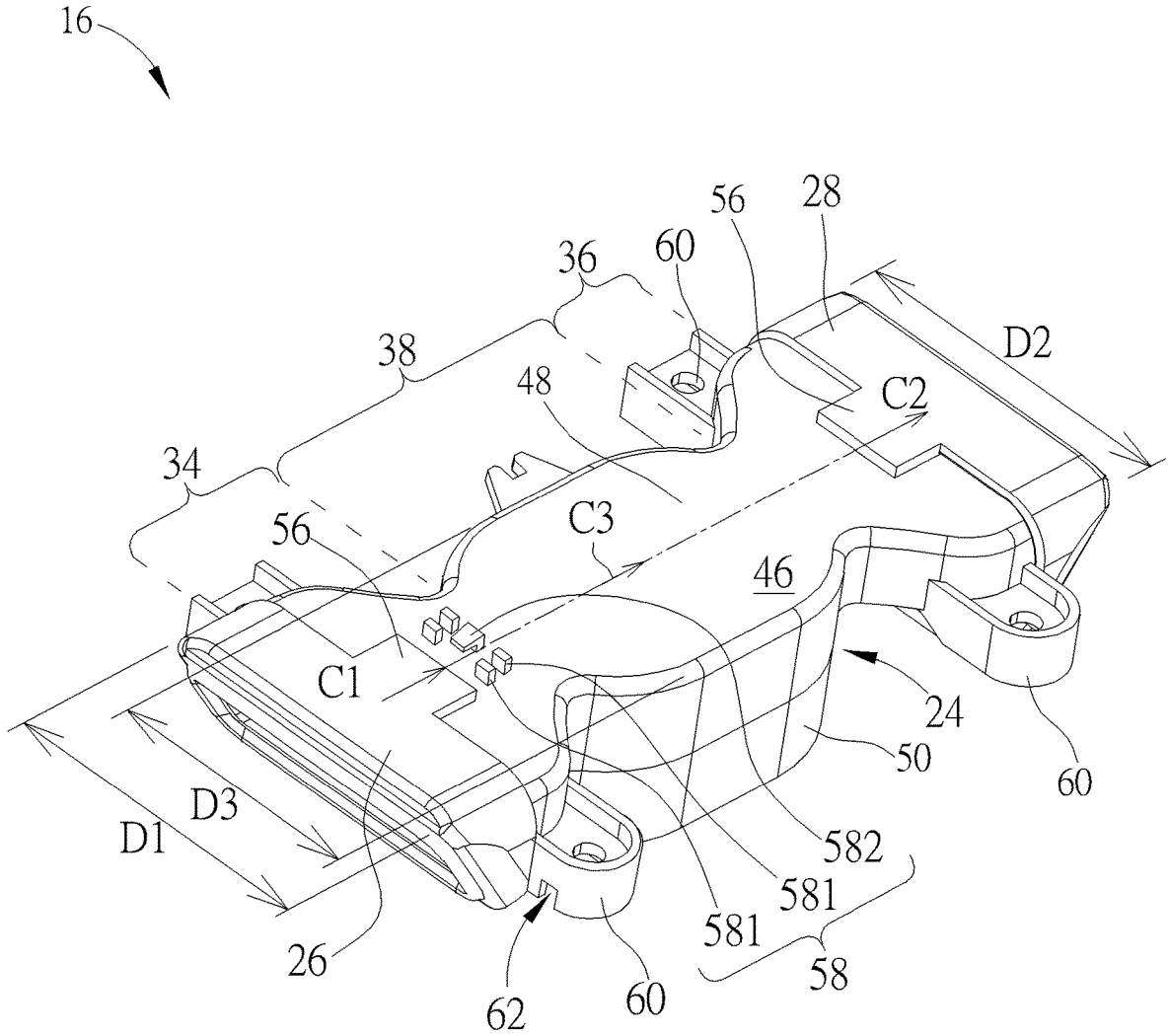
FIG. 3 and FIG. 4 are diagrams of a sound transmission holder in different views according to the embodiment of the present disclosure.
Figure 4:
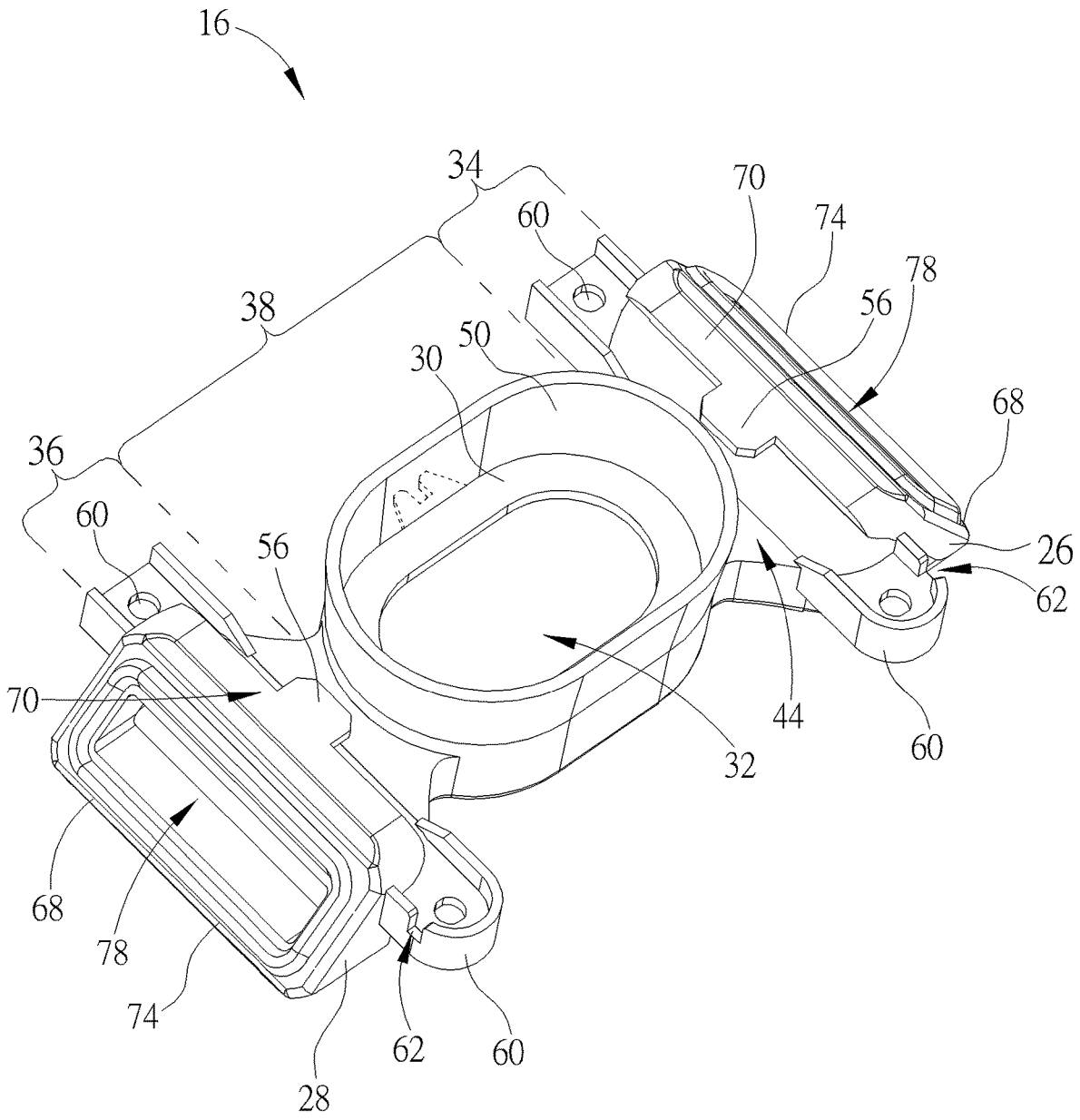
Figure 5:
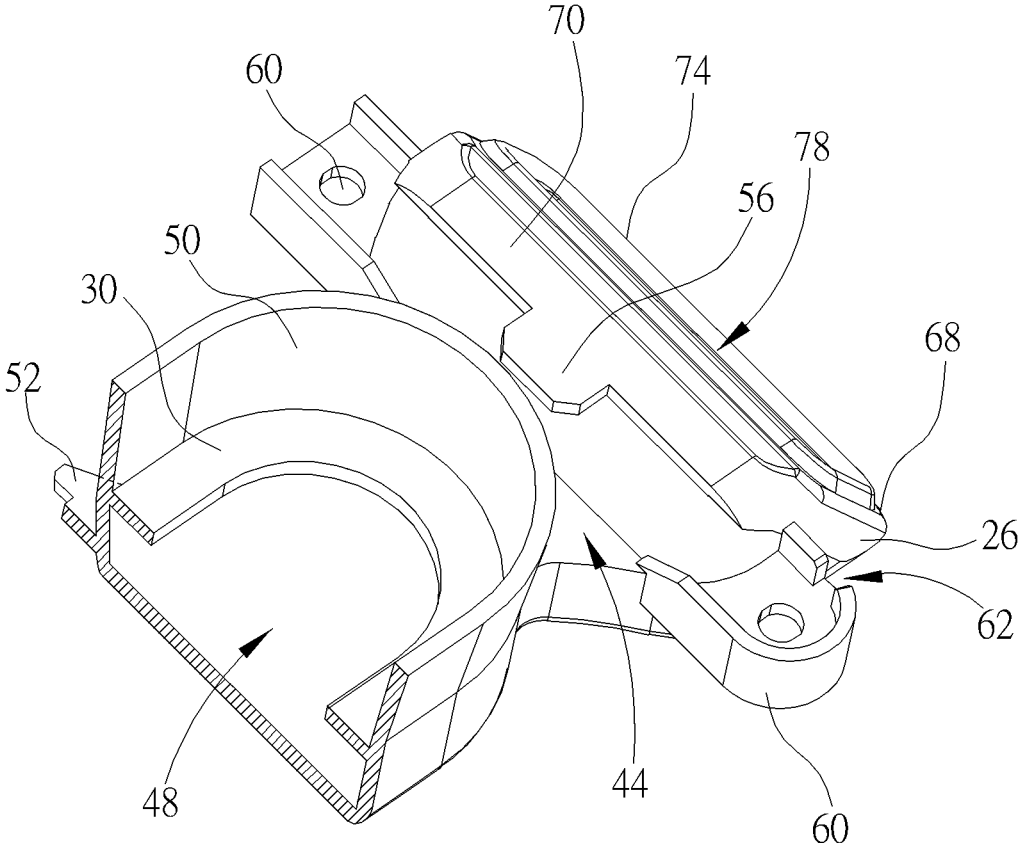
FIG. 5 is a sectional view of a right side of the sound transmission holder shown in FIG. 4.
Figure 6:
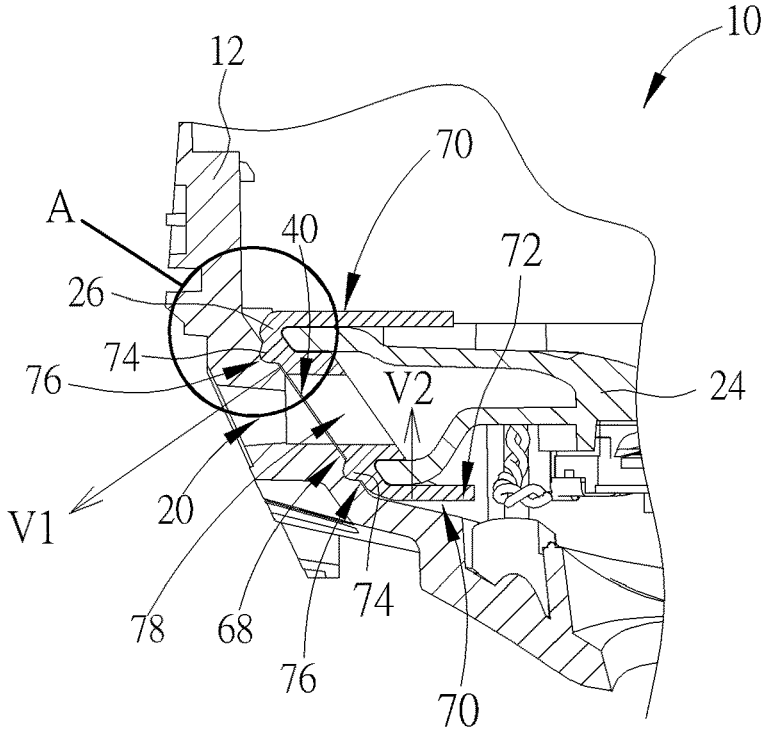
FIG. 6 is a sectional view of a part of the electronic device according to the embodiment of the present disclosure.

Please refer to FIG. 1 to FIG. 5. FIG. 3 and FIG. 4 are diagrams of the sound transmission holder 16 in different views according to the embodiment of the present disclosure. FIG. 5 is a sectional view of a right side of the sound transmission holder 16 shown in FIG. 4. The sound transmission holder 16 can include a frame body 24, a first bridging portion 26, a second bridging portion 28 and an accommodating portion 30. The frame body 24 can have a sound transmission portion 32. Two opening ends 78 (which are shown in FIG. 6) of the sound transmission portion 32 can be respectively connected to the first sound penetrating hole 20 of the casing 12 via the first bridging portion 26 and the second sound penetrating hole 22 of the casing 12 via the second bridging portion 28. The frame body 24 can be divided into a first section 34, a second section 36 and a third section 38. The first section 34 and the second section 36 can be respectively disposed on two opposite sides of the third section 38. It should be mentioned that the first section 34, the second section 36 and the third section 38 can be connected to each other, so that an inner space connected between the first section 34, the second section 36 and the third section 38 of can be hollow for forming the sound transmission portion 32.

The first bridging portion 26 can be disposed around the first section 34. The second bridging portion 28 can be disposed around the second section 36. When the sound transmission holder 16 is disposed inside the casing 12, the first bridging portion 26 can align with the first sound penetrating hole 20, and the second bridging portion 28 can align with the second sound penetrating hole 22. The first bridging portion 26 and the second bridging portion 28 can be preferably made of material with resilient deformation and recovery property. The first bridging portion 26 and the second bridging portion 28 can respectively abut against two opposite inner walls 40 and 42 of the casing 12, so as to fix position of the frame body 24, and further to fill a gap between the casing 12 and the sound transmission holder 16 for preventing the electronic device 10 from being damaged by liquid via the said gap. The accommodating portion 30 can be disposed on the third section 38 and adapted to accommodate the sound generating unit 14. The sound signal of the sound generating unit 14 can be transmitted into the sound transmission portion 32 of the frame body 24 through the accommodating portion 30, and then transmitted to outward of the electronic device 10 via the first sound penetrating hole 20 and the second sound penetrating hole 22 by passing the first bridging portion 26 and the second bridging portion 28.

In other possible embodiments, a number and position of the bridging portion are not limited to the first bridging portion 26 and the second bridging portion 28 of the foresaid embodiment. For example, the frame body may be designed as T-type, and the sound transmission holder can include three bridging portions respectively disposed on three ends of the T-type frame body for providing three sound sending directions. Further, the frame body may be designed as X-type, and the sound transmission holder can include four bridging portions respectively disposed on four ends of the X-type frame body for providing four sound sending directions; variation of the frame body and the sound transmission holder can depend on an actual demand.

In the embodiment of the present disclosure, the first section 34 and the second section 36 of the frame body 24 preferably can be symmetric structures with the same dimensions, which depend on the actual application; in some possible embodiments, the dimensions and a shape of the first section 34 may be different from the dimensions and the shape of the second section 36. For example, if the first section 34 and the second section 36 are the symmetric structures with the same dimensions, the frame body 24 can be designed as H-type; if the first section 34 and the second section 36 both have long lower ends and short upper ends, the frame body 24 can be designed as U-type. In addition, a width D1 of the first section 34 and a width D2 of the second section 36 preferably can be greater or wider than a width D3 of the third section 38, and a central line C1 of the first section 34 and a central line C2 of the second section 36 preferably can align with or be close to a central line C3 of the third section 38; that is to say, the first section 34 (or the second section 36) can be connected to center of the third section 38, and stretched from the center to two opposite sides (such as a right side and a left side, or an upper side and a lower side) of the third section 38, so that the structural dimensions of the first section 34 (or the second section 36) can be greater than the structural dimensions of the third section 38.

The third section 38 can have a first surface 44 and a second surface 46 opposite to each other. The accommodating portion 30 can be disposed on the first surface 44, and a sound box 48 of the sound transmission holder 16 can be disposed on the second surface 46. The sound box 48 may be a chamber with smooth space and a regular shape, such as a square structure or a rectangular structure. The sound box 48 can avoid the sound signal from being affected by echo due to scattering or reflection, so as to effectively improve high frequency efficacy of the sound signal. Besides, the sound transmission holder 16 can further include a covering portion 50 disposed on the first surface 44 of the third section 38 and adapted to cover the sound generating unit 14. The covering portion 50 can be designed for providing a sealed chamber, and an inner volume of the sealed chamber can be preferably greater than or equal to five cubic centimeter for effectively increasing low frequency efficacy of the sound signal.

The covering portion 50 can be the sealed chamber connected to the third section 38 and used to cover the sound generating unit 14 to achieve sealed efficacy. Further, the covering portion 50 may be an unsealed chamber with an opening; when the sound transmission holder 16 is disposed inside the casing 12, the covering portion 50 can abut against an inner surface of the casing 12, and the opening of the covering portion 50 (which means the unsealed chamber) can be sheltered by the casing 12 to provide the sealed efficacy. In addition to the embodiment of disposing the covering portion 50 on the third section 38, the covering portion 50 may be optionally disposed on position of the casing 12 relevant to the sound generating unit 14 and/or the accommodating portion 30. The covering portion 50 disposed on the casing 12 can be the sealed space or the unsealed space, which has structural design similar to the embodiment of disposing the covering portion 50 on the third section 38, and a detailed description can be omitted herein for simplicity.

The sound transmission holder 16 can further include a first positioning portion 52 disposed on the frame body 24 or the accommodating portion 30. The casing 12 can include a second positioning portion 54 disposed on somewhere relevant to the first positioning portion 52. When the sound transmission holder 16 is disposed inside the casing 12, the first positioning portion 52 can be engaged with the second positioning portion 54 to provide the foolproof and constraining function. In the embodiment, the first positioning portion 52 can be a clamp structure, and the second positioning portion 54 can be a slide bar structure. The first positioning portion 52 can clamp and slide relative to the second positioning portion 54. An actual application of the first positioning portion 52 and the second positioning portion 54 is not limited to the foresaid embodiment; for example, the first positioning portion 52 can be the slide bar structure and then the second positioning portion 54 can be the clamp structure, or the first positioning portion 52 and the second positioning portion 54 can be formed by other structures.

The first bridging portion 26 and/or the second bridging portion 28 of the sound transmission holder 16 can optionally include a stretching section 56. The present disclosure may smear adhesive over an inner surface of the first bridging portion 26 (or the second bridging portion 28), and the first bridging portion 26 (or the second bridging portion 28) can be adhered to the first section 34 (or the second section 36) of the frame body 24. When the inner surface of the first bridging portion 26 (or the second bridging portion 28) has the adhesive, the stretching section 56 may have no adhesive and can be touched by a user; further, the stretching section 56 may have the adhesive and be adhered to the first section 34 and the second section 36. The frame body 24 can further include a wire arrangement structure 58 used to fix a signal transmission wire 66 of the sound generating unit 14. The wire arrangement structure 58 may have at least one of a plank part 581 and a bending part 582. The plank part 581 can constrain a movement of the signal transmission wire 66. The bending part 582 can prevent the signal transmission wire 66 from being separated from the frame body 24.

The sound transmission holder 16 can dispose one or several locking parts 60 on the first section 34 and the second section 36 of the frame body 24. The present disclosure can utilize a fixing component 64 to pass through the locking part 60 and lock into a corresponding locked hole (which is not shown in the figures) of the casing 12, to ensure that the sound transmission holder 16 can be tightly installed inside casing 12. The fixing component 64 can be a screw or a bolt or any component with the same or similar function. Each locking part 60 can optionally have an adhesive leaking part 62 adjacent to the first bridging portion 26 or the second bridging portion 28. When the first bridging portion 26 (or the second bridging portion 28) is smeared by the adhesive and disposed on the frame body 24, some adhesive may be leaked into a gap between the first bridging portion 26 (or the second bridging portion 28) and the frame body 24 and then flow into the locking part 60. If the leaked adhesive is not removed from the locking part 60, the fixing component 64 may not pass through the locking part 60 due to the dried leaked adhesive, so that the redundant leaked adhesive can be removed via the adhesive leaking part 62.

Figure 7:
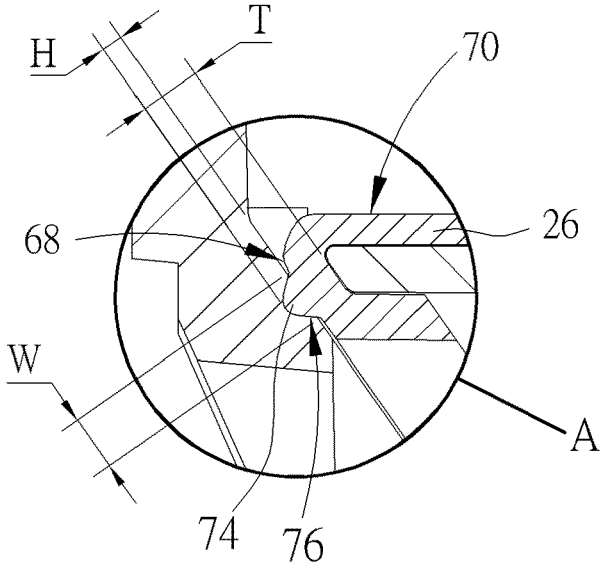
FIG. 7 is an enlarged diagram of an area shown in FIG. 6.

Please refer to FIG. 6 and FIG. 7. FIG. 6 is a sectional view of a part of the electronic device 10 according to the embodiment of the present disclosure. FIG. 7 is an enlarged diagram of an area A shown in FIG. 6. As an example of the first bridging portion 26, the first bridging portion 26 can have a waterproof contacting surface 68 and an orientation abutting surface 70. The waterproof contacting surface 68 can contact against the inner wall 40 adjacent to the first sound penetrating hole 20. The orientation abutting surface 70 can abut against other inner wall 72 of the casing 12. An angle between a planar normal vector V1 of the waterproof contacting surface 68 and a planar normal vector V2 of the orientation abutting surface 70 can be preferably ranged between 30~75 degrees; for example, the preferred angle can be set as 55 degrees. Any angle smaller than 90 degrees can provide the suitable waterproof efficacy; however, an actual value of the said angle depends on the actual demand.

Besides, as the example of the first bridging portion 26, the first bridging portion 26 can include an annular protruding part 74 disposed on the waterproof contacting surface 68, and the casing 12 can include an annular slot 76. When the sound transmission holder 16 is disposed inside the casing 12, the waterproof contacting surface 68 of the first bridging portion 26 can contact against the inner wall 40 of the casing 12, and the annular protruding part 74 can abut against the annular slot 76 to prevent the electronic device 10 from being leaked by liquid through some small gap between the sound transmission holder 16 and the casing 12. In the embodiment, one annular protruding part 74 is disposed on the first bridging portion 26, and a number of the annular protruding part 74 is not limited to the foresaid embodiment; for example, a plurality of annular protruding parts 74 having different radial dimensions can be disposed on the first bridging portion 26. In the embodiment, a height H of the annular protruding part 74 preferably can be ranged between 25~30 percent of a thickness T of the first bridging portion 26, and a width W of the annular protruding part 74 preferably can be greater than or equal to one millimeter; an actual value of the height and the width of the annular protruding part 74 can be set according to the design demand.

Figure 8:
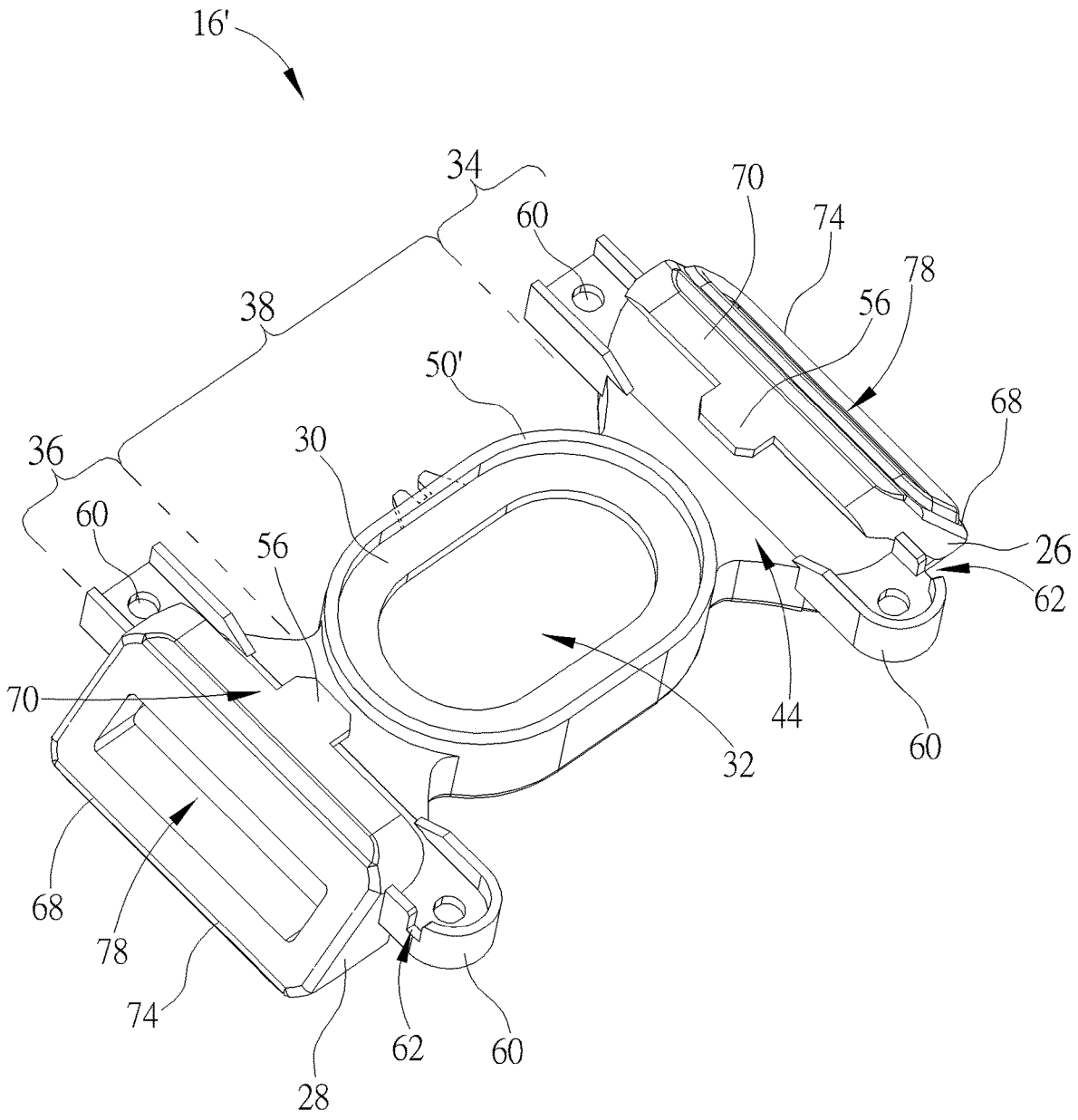
FIG. 8 is a diagram of the sound transmission holder according to another embodiment of the present disclosure.

Please refer to FIG. 8. FIG. 8 is a diagram of the sound transmission holder 16' according to another embodiment of the present disclosure. In this embodiment, elements having the same numerals as one of the foresaid embodiment have the same structures and functions, and a detailed description can be omitted herein for simplicity. Difference between this embodiment and the foresaid embodiment is: a height of the covering portion 50' of the sound transmission holder 16' can be smaller than the height of the covering portion 50, so that the sound transmission holder 16' can be disposed inside a narrow space for applying to the thin-type electronic device.

In conclusion, the sound transmission holder and the related speaker assembly and the related electronic device of the present disclosure can design the sound transmission portion on the frame body, and the sound transmission portion can be connected to the sound penetrating holes of the casing via the bridging portions, so that one sound generating unit can provide multichannel sound efficacy. The bridging portion and the frame body can be integrated monolithically, or can be two independent components assembled with each other. The frame body of the sound transmission holder can have the sound box with the smooth shape and the covering portion for enlarging the sealed space, and therefore the sound generating unit can provide the preferred high frequency efficacy and the preferred low frequency efficacy. The bridging portion of the sound transmission holder can design the specific inclined angle of the waterproof contacting surface and the orientation abutting surface, and further dispose the annular protruding part on the bridging portion for providing the preferred waterproof efficacy of the sound transmission holder.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A sound transmission holder of matching with a sound generating unit, the sound transmission holder comprising:

a frame body having a first section, a second section and a third section, the first section and the second section being disposed on two opposite sides of the third section, wherein the first section, the second section and the third section are hollow and connected to each other;

a first bridging portion being hollow and disposed on the first section;

a second bridging portion being hollow and disposed on the second section, the first bridging portion and the second bridging portion abutting against an external casing and being connected to the frame body; and an accommodating portion disposed on the third section, and the sound generating unit being connected to the accommodating portion.

2. The sound transmission holder of claim 1, wherein the first section, the second section and the third section are connected to form a sound transmission portion, the sound transmission portion has two opening ends opposite to each other, and a width of the first section is wider than a width of the third section.

3. The sound transmission holder of claim 1, wherein the accommodating portion is disposed on a first surface of the third section, the sound transmission holder further comprises a sound box disposed on a second surface of the third section opposite to the first surface.

4. The sound transmission holder of claim 1, further comprising:

a covering portion disposed on the third section and adapted to cover the sound generating unit.

5. The sound transmission holder of claim 1, wherein the first bridging portion comprises a waterproof contacting surface and an orientation abutting surface, the waterproof contacting surface contacts an inner wall of the external casing, the orientation abutting surface abuts another inner wall of the external casing, and an angle between a planar normal vector of the waterproof contacting surface and a planar normal vector of the orientation abutting surface is ranged between 30~75 degrees.

6. The sound transmission holder of claim 5, wherein the first bridging portion comprises an annular protruding part disposed on the waterproof contacting surface and adapted to contact an annular slot of the external casing.

7. The sound transmission holder of claim 1, further comprising:

a first positioning portion disposed on one of the frame body and the accommodating portion.

8. The sound transmission holder of claim 1, wherein the first bridging portion comprises a stretching section.

9. The sound transmission holder of claim 1, wherein the first section comprises a locking part and an adhesive leaking part, and the adhesive leaking part is disposed on the locking part and adjacent to the first bridging portion.

10. The sound transmission holder of claim 1, wherein the frame body further has a wire arrangement structure comprising at least one of a plank part and a bending part and adapted to constrain a signal transmission wire of the sound generating unit.

11. An electronic device with a sound generating and waterproofing function, comprising:

a casing with an accommodating space, a first sound penetrating hole and a second sound penetrating hole of the casing being connected to the accommodating space; and a speaker assembly comprising:

a sound generating unit; and a sound transmission holder disposed inside the accommodating space, the sound transmission holder comprising:

a frame body having a first section, a second section and a third section, the first section and the second section being disposed on two opposite sides of the third section, wherein the first section, the second section and the third section are hollow and connected to each other;

a first bridging portion being hollow and disposed on the first section and aligning with the first sound penetrating hole;

a second bridging portion being hollow and disposed on the second section and aligning with the second sound penetrating hole, the first bridging portion and the second bridging portion respectively abutting against an inner wall of the casing; and an accommodating portion disposed on the third section, the sound generating unit being connected to the accommodating portion.

12. The electronic device of claim 11, wherein the first section, the second section and the third section are connected to form a sound transmission portion, the sound transmission portion has two opening ends opposite to each other, and a width of the first section facing one of the opening ends is greater than a width of the third section across the sound transmission portion.

13. The electronic device of claim 11, wherein the accommodating portion is disposed on a first surface of the third section, the sound transmission holder further comprises a sound box disposed on a second surface of the third section opposite to the first surface.

14. The electronic device of claim 11, wherein the sound transmission holder further comprises a covering portion disposed on the third section and adapted to cover the sound generating unit.

15. The electronic device of claim 11, wherein the first bridging portion comprises a waterproof contacting surface and an orientation abutting surface, the waterproof contacting surface contacts the inner wall adjacent to the first sound penetrating hole, the orientation abutting surface abuts another inner wall of the casing, and an angle between a planar normal vector of the waterproof contacting surface and a planar normal vector of the orientation abutting surface is ranged between 30~75 degrees.

16. The electronic device of claim 15, wherein the first bridging portion comprises an annular protruding part disposed on the waterproof contacting surface and adapted to contact an annular slot of the casing.

17. The electronic device of claim 11, wherein the sound transmission holder further comprises a first positioning portion disposed on one of the frame body and the accommodating portion, and adapted to engage with a second positioning portion of the casing.

18. The electronic device of claim 11, wherein the first bridging portion comprises a stretching section, the first section comprises a locking part and an adhesive leaking part, and the adhesive leaking part is disposed on the locking part and adjacent to the first bridging portion.

19. The electronic device of claim 11, wherein the frame body further has a wire arrangement structure comprising at least one of a plank part and a bending part and adapted to constrain a signal transmission wire of the sound generating unit.

20. A speaker assembly, comprising:

a sound generating unit; and a sound transmission holder assembled with the sound generating unit for transmitting a sound signal output by the sound generating unit, the sound transmission holder comprising:

a frame body having a first section, a second section and a third section, the first section and the second section being disposed on two opposite sides of the third section, wherein the first section, the second section and the third section are hollow and connected to each other;

a first bridging portion being hollow and disposed around the first section;

a second bridging portion being hollow and disposed around the second section, the first bridging portion and the second bridging portion abutting against an external casing; and an accommodating portion disposed on the third section, the sound generating unit being connected to the accommodating portion, so that the sound signal is transmitted to the first bridging portion and the second bridging portion through the frame body.

* * * * *